United States Patent [19]

Christensen

[11] 4,304,379

[45] Dec. 8, 1981

[54] BAG HOLDER

[76] Inventor: James H. Christensen, 2736 Ensign Ave. North, Minneapolis, Minn. 55427

[21] Appl. No.: 79,982

[22] Filed: Sep. 28, 1979

[51] Int. Cl.[3] ..... B65B 67/04

[52] U.S. Cl. ..... 248/101

[58] Field of Search ..... 248/94, 99, 100, 101, 248/315

[56] References Cited

U.S. PATENT DOCUMENTS

| | | | |
|---|---|---|---|
| 488,851 | 12/1892 | Stock | 248/99 X |
| 637,248 | 11/1899 | Hagstrom | 248/101 |
| 1,193,024 | 8/1916 | Kennedy | 248/315 X |
| 1,664,658 | 4/1928 | Blazer | 248/101 X |
| 1,809,317 | 6/1931 | Snyder | 248/101 X |
| 1,996,303 | 4/1935 | McConnell | 248/99 |
| 2,457,918 | 1/1949 | Pierce | 248/99 X |
| 2,710,732 | 6/1955 | Peters | 248/100 |
| 3,218,014 | 11/1965 | Frazier | 248/101 |
| 3,870,261 | 3/1975 | McSwain | 248/101 |

*Primary Examiner*—William H. Schultz
*Attorney, Agent, or Firm*—John W. Adams

[57] ABSTRACT

A bag holder removeably mountable on a wall by means of a supporting ring anchored to the holder for providing circumferential support for the open end of a bag, said holder, and having a clamping element pivotally mounted on said ring to permit clamping and anchoring the mouth of the bag to the supporting ring. A cover is also provided for the holder.

3 Claims, 9 Drawing Figures

BAG HOLDER

BACKGROUND OF THE INVENTION

A large number of bag holders have been developed in the past. Some of these are wall mounted units. The prior art devices are relatively expensive and have failed to provide a holder which is removeably mounted on a wall and which includes circumferential clamping ring around the top of the bag for securely anchoring the bag to the supporting ring.

SUMMARY OF THE INVENTION

The invention disclosed and claimed herein provides a supporting ring which is postively attached to a mounting member which in turn is removeably mounted on a wall. The bag is draped over the supporting ring and is secured thereto by a clamping ring segment, the ends of which are pivotally mounted on the supporting ring to facilitate alignment of the clamping ring with the underlying portions of the supporting ring and the bag.

DETAILED DESCRIPTION OF A PREFERRED EMBODIMENT OF THE INVENTION

Figure 2:
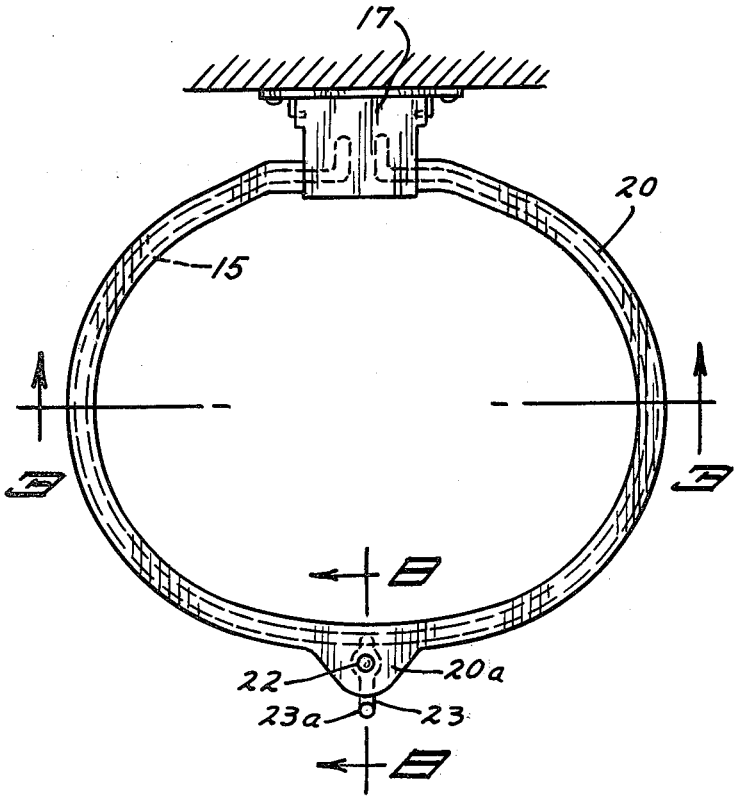
FIG. 2 is a top plan view thereon.
Figure 3:
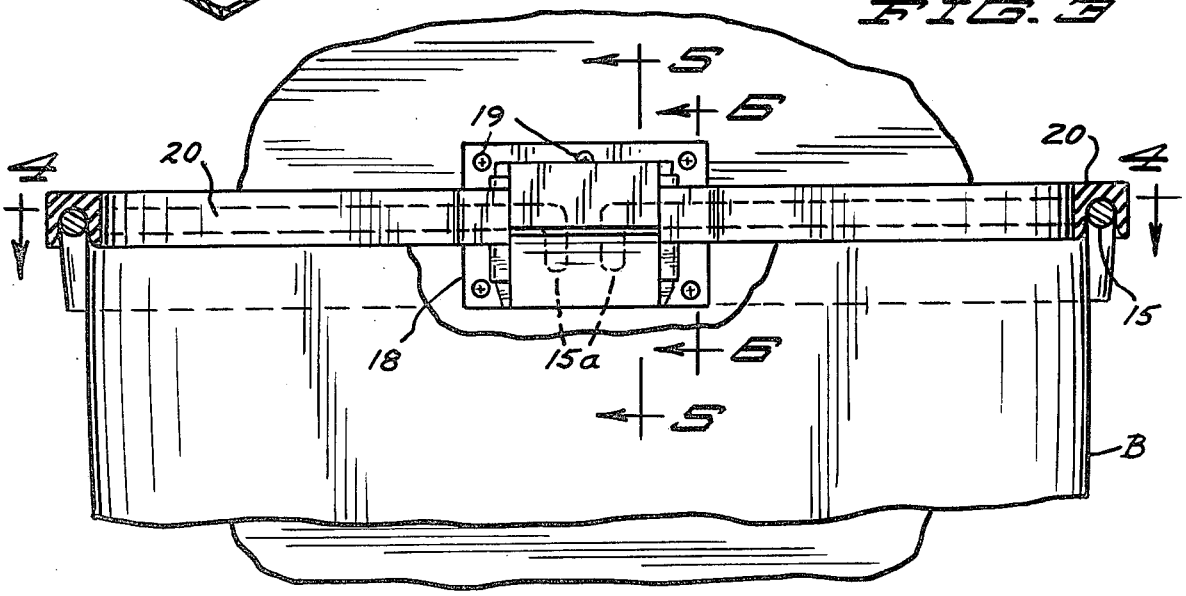
FIG. 3 is a vertical sectional view taken substantially along the line 3—3 of FIG. 2.
Figure 5:
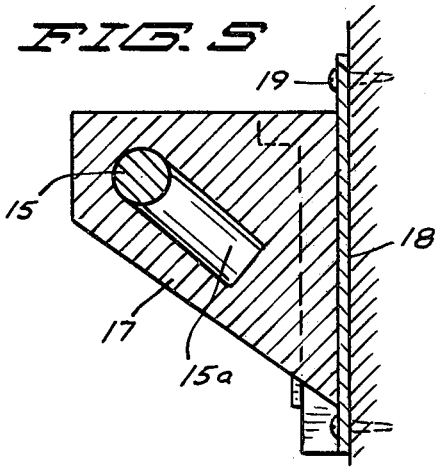
FIG. 5 is a vertical sectional view taken substantially along the line 5—5 of FIG. 3.
Figure 8:
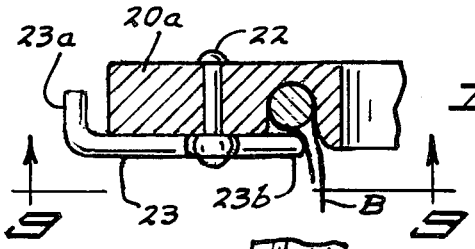
FIG. 8 is a fragmentary sectional view taken substantially along the line 8—8 of FIG. 2.
Figure 9:
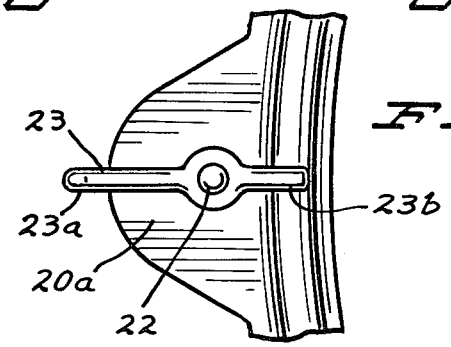
FIG. 9 is a fragmentary bottom plan view as viewed along line 9—9 of FIG. 8.
Figure 6:
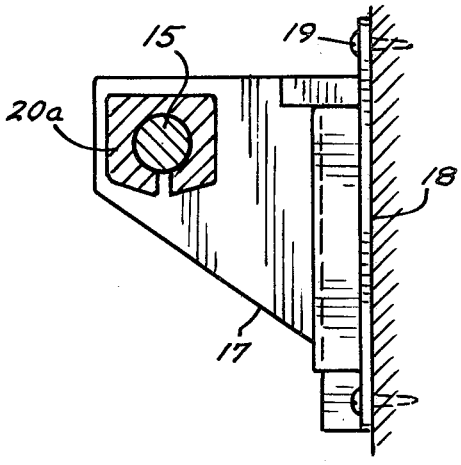
FIG. 6 is a vertical sectional view taken substantially along the line 6—6 of FIG. 3.
Figure 7:
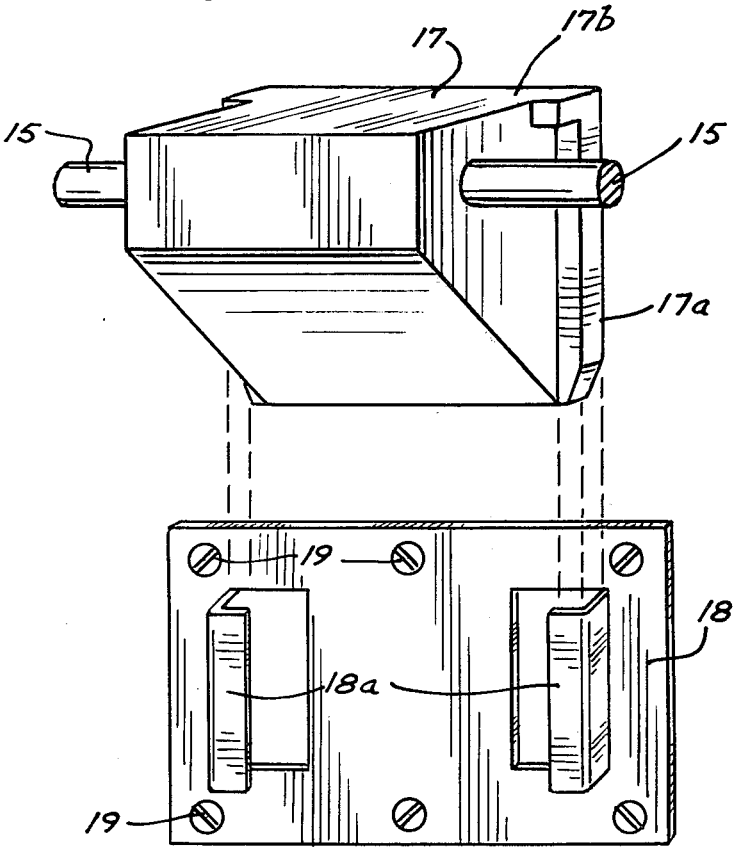
FIG. 7 is a perspective showing the wall-mounted bracket with the ring supporting member positioned for insertion into the bracket.

In the embodiment of the invention illustrated, a supporting ring or rod 15 is provided. This supporting ring is fixed to a mounting member 17 which, in the form shown, constitutes a solid block of material such as metal or a suitable plastic material, many of which are well known in the art. The rod 15 has anchoring elements 15*a* formed on the inner ends thereof as by bending the end portions of the rod. These ends 15*a* are embedded in the mounting block 17 as best shown in FIGS. 2, 3 and 5. The end portions of the rod 15 provide torsional cantilever support for the rod 15 and the angle at which the anchoring elements 15*a* are disposed in the block 17 is designed to provide inwardly directed resultant forces on the portions of the block surrounding the same. This angle is approximately 45 degrees as illustrated in FIG. 5.

The block 17 is provided with a pair of mounting flanges 17*a* on the sides thereof and a stop element 17*b* is provided at the top of each mounting flange. A wall mounted plate 18 is provided and a pair of channel elements 18*a* are formed from the material thereof to receive the flange elements 17*a* and engage the stop elements 17*b* when the block is mounted in operative position thereof. The plate 18 is attached to the wall by screw elements 19 as illustrated and at least the center screws are countersunk to permit the back side of the block 17 to fit flush with the plate surface and slide freely into and out of the screws to channel.

Figure 1:
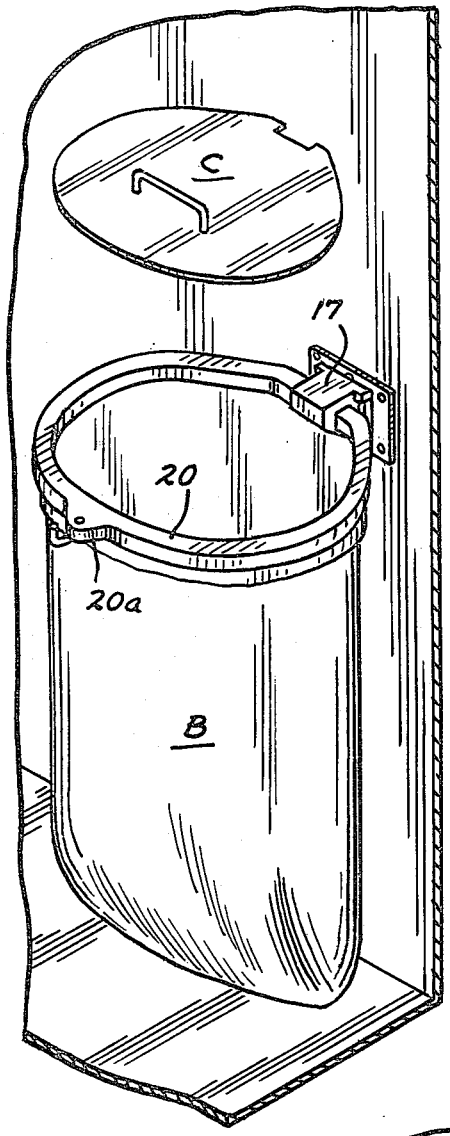
FIG. 1 is a perspective view showing my bag holder in operative position with a bag mounted thereon.
Figure 4:
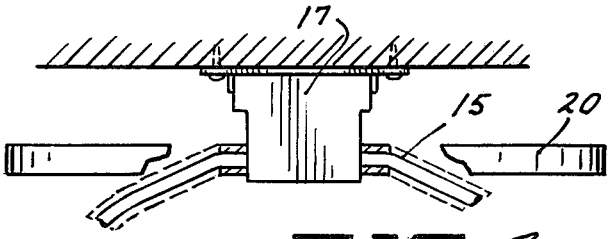
FIG. 4 is a fragmentary top plan view of the supporting ring with a portion of the clamping element shown in raised position.

A bag B, usually made from plastic sheet material, is mounted on the ring 15 and is attached thereto by means of a clamping ring 20 which, as shown in FIG. 3, has a clamping channel formed therein to receive the rod 15 and anchor the bag there within. The ring 20 is substantially co-terminus with supporting ring 15 as illustrated and the ends of the clamping ring 20 are provided with attachment portions 20*a* which closely surround and pivotally grip the rod adjacent to mounting block 17 as best shown in FIGS. 1, 2 and 4. These mounting elements 20*a* at the ends of the clamping ring 20 are split for insertion over and around engaged portions of rod 15 and securely grip said rod to provide a pivotal anchor for the clamping ring 20. This permits the ring to wing upwardly into retracted position as shown in FIG. 4 to permit changing the bags. The shoulder portions of the rings 15 and 20 extending outwardly from the mounting block 17 are initially straight and have bend portions positioned laterally outwardly from the straight mounting portions at an angle sufficient to permit clearance of the clamping ring 20 as it is raised into its upper retracted position as shown in FIG. 4.

A protuberance 20*a* is formed at the front edge of the ring 20 and has an attachment pin 22 extending therethrough. A latch element 23 has a latch portion 23*b* on the inner end and an operating element 23*a* on the outer end. The outer element 23*a* rides around the generally circular outer surface of the protuberance 20*a*. The latch portion underlies the rod 15 when in operative latching position to lock the clamping ring 20 onto the rod. The latch element may be pivotted into releasing position to permit the ring to be raised and the bag changed.

It will be seen that I have provided relatively simple yet extremely efficient support for a trash bag and the like. A cover C may be provided if desired.

What is claimed is:

1. A bag holder comprising a generally circular supporting ring, an anchoring element fixed to said ring with means for attaching the same to a wall, a clamping ring having an underlying groove formed therein to receive the supporting ring and securely anchor the upper portion of a bag to said supporting ring, means for providing a positive fixed connection between the anchoring element and the ring, said clamping ring having an outwardly extending protuberance formed in diametrically opposed relation to the connection means between said ring and said anchoring element, and a latch element connected with said protuberance to positively lock said clamping ring onto said supporting ring.

2. The structure set forth in claim 1 and said latch element being pivotally mounted on bottom side of said protuberance to permit the same to be swung into underlying latching position with respect to said rod but permitting release thereof to facilitate lifting the clamping ring and changing a bag.

3. The structure set forth in claim 1 and said clamping ring having a pair of mounting elements at the inner ends thereof for closely surrounding said supporting ring but permitting said clamping ring to be pivotally raised into elevated position.

* * * * *